US005913435A

United States Patent [19]

Fuchs

[11] Patent Number: 5,913,435

[45] Date of Patent: Jun. 22, 1999

[54] CLOSURE WITH SNAP-TYPE HINGE CAP

[75] Inventor: Timothy James Fuchs, Perrysburg, Ohio

[73] Assignee: Owens-Illinois Closure Inc., Toledo, Ohio

[21] Appl. No.: 08/845,069

[22] Filed: Apr. 21, 1997

[51] Int. Cl.[6] ..... B65D 47/06

[52] U.S. Cl. ..... 215/237; 215/235; 220/335; 220/339

[58] Field of Search ..... 215/235, 237, 215/244; 220/335, 339

[56] References Cited

U.S. PATENT DOCUMENTS

| | | | |
|---|---|---|---|
| 3,082,903 | 3/1963 | Stevens et al. . | |
| 3,628,215 | 12/1971 | Everburg . | |
| 3,629,901 | 12/1971 | Wolf . | |
| 3,741,447 | 6/1973 | Miles et al. . | |
| 3,933,271 | 1/1976 | McGhie . | |
| 4,047,495 | 9/1977 | O'Brian . | |
| 4,170,315 | 10/1979 | Dubach et al. . | |
| 4,193,519 | 3/1980 | Dubach et al. . | |
| 4,386,714 | 6/1983 | Roberto et al. . | |
| 4,403,712 | 9/1983 | Wiesinger . | |
| 4,545,495 | 10/1985 | Kinsley . | |
| 4,573,600 | 3/1986 | Dubach . | |
| 4,638,916 | 1/1987 | Beck et al. . | |
| 4,795,044 | 1/1989 | Beck | 215/237 |
| 4,854,473 | 8/1989 | Dubach | 220/335 |
| 4,917,253 | 4/1990 | Dutt . | |
| 5,115,931 | 5/1992 | Dubach | 215/235 |
| 5,141,138 | 8/1992 | Odet et al. . | |
| 5,145,646 | 9/1992 | Tyranski . | |
| 5,148,912 | 9/1992 | Nozawa . | |
| 5,221,017 | 6/1993 | Cistone et al. . | |
| 5,257,708 | 11/1993 | Dubach . | |
| 5,361,920 | 11/1994 | Nozawa et al. . | |
| 5,386,918 | 2/1995 | Neveras et al. . | |
| 5,392,938 | 2/1995 | Dubach | 215/254 |
| 5,435,456 | 7/1995 | Dubach | 220/335 |
| 5,489,035 | 2/1996 | Fuchs . | |

FOREIGN PATENT DOCUMENTS

| | | |
|---|---|---|
| 0727361 | 2/1996 | European Pat. Off. . |
| 2610599 | 8/1988 | France . |
| 683985 | 6/1994 | Switzerland . |

*Primary Examiner*—Stephen K. Cronin

[57] ABSTRACT

A closure with a snap type hinge cap including a first part adapted to interengage with the open neck of the container and a second part forming a cap. An integral hinge interconnects the first part and second part. Each of the parts includes a base wall and a peripheral skirt. A pair of hinged straps are attached to the skirts and extend from the skirts on opposite side of the integral hinge. The ends of the straps are straight and lie in substantially the same plane when the first part and second part are in fully open position. Each strap is stretched along its length during opening and closing of the first part and the second part. Each strap has a portion intermediate the ends which extends out of the plane when the first part and second part are in fully open position. Each intermediate portion of each strap is thinner than the ends of said strap. Each strap is untensioned when the first part and second part are in fully open position.

16 Claims, 4 Drawing Sheets

CLOSURE WITH SNAP-TYPE HINGE CAP

This invention relates to closures and particularly to closures of the type which include a cap that is connected to the remainder of the closure by an internal hinge.

BACKGROUND AND SUMMARY OF THE INVENTION

It has heretofore been proposed that closures be provided for containers wherein the closures on the container by an integral hinge. Conventionally, such closures rely on tension on the hinge to produce a snap action. Typical constructions are shown in U.S. Pat. Nos. 3,628,215, 3,629,901, 3,933, 271, 4,047,495 and 4,386,714.

In U.S. Pat. No. 4,638,916, a closure with a snap type hinge cap comprises a first part adapted to interengage with the open neck of a container, a second part forming a cap and an integral hinge interconnecting the first and second parts comprises a base wall and a peripheral skirt. A pair of hinge straps extends from the skirts and are positioned on opposite sides of the integral hinge. The radial length of the pair of hinge straps is less than the length of the arc through which the second cap part moves to and from and closed position relative to the first part such that the pair of straps stretch to function as springs. The ends of the pair of straps are attached to the skirts radially inwardly of the periphery of the skirts.

In U.S. Pat. No. 5,489,035, there is disclosed a closure with a snap type hinge cap which comprises a first part adapted to interengage with the open neck of a container, a second part forming a cap and an integral hinge interconnecting the first part and second part. Each of these parts comprises a base wall and a peripheral skirt. A pair of hinge straps extend from the skirts on opposite side of the integral hinge. The ends of the straps are straight and lie in substantially the same plane when the first part and second part in fully open position. Each strap has a portion intermediate the ends which extends out of the plane. Each strap is untensioned when the first part and second part are in fully open position. The intermediate portions of the straps extend axially in one direction. In one form, the intermediate portions of said straps are curved in cross section. In another form, intermediate portions of said straps are V-shaped in cross section.

Among the objectives of the present invention are to provide an improved closure with a snap-type hinge cap like that in U.S. Pat. No. 5,489,035 with improved performance and longer life; which further reduces or eliminates excessive stress on the straps during opening and closing which might cause breaking; and which can be made with minimal added cost.

In accordance with the invention, a closure with a snap type hinge cap comprises a first part adapted to interengage with the open neck of a container and a second part forming a cap. An integral hinge interconnects the first part and second part. Each of said parts comprises a base wall and a peripheral skirt. A pair of hinged straps are attached to the skirts and extend from the skirts on opposite side of said integral hinge. The end of the straps are straight and lie in substantially the same plane when the first part and second part are in fully open position. Each strap is stretched along its length during opening and closing of the first part and the second part. Each strap has a portion intermediate the ends which extends out of said plane when the first part and second part are in fully open position. Each strap has an intermediate portion which is thinner than the ends of the strap. Each strap is untensioned when the first part and second part are in fully open position. The intermediate portion of each strap extends axially downwardly or axially upwardly. In another form, the intermediate portion includes a transverse ledge or step at its ends. In a further form, the straps include a transverse ledge or strap and have the same thickness throughout.

DESCRIPTION OF THE PREFERRED EMBODIMENTS

Figure 1:
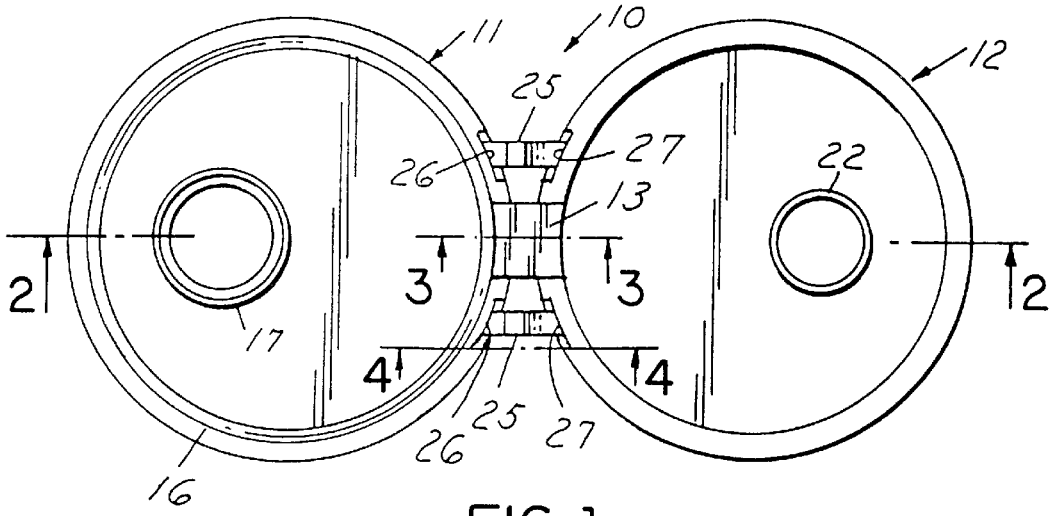
FIG. 1 is a plan view of a closure embodying the invention in open position.
Figure 2:
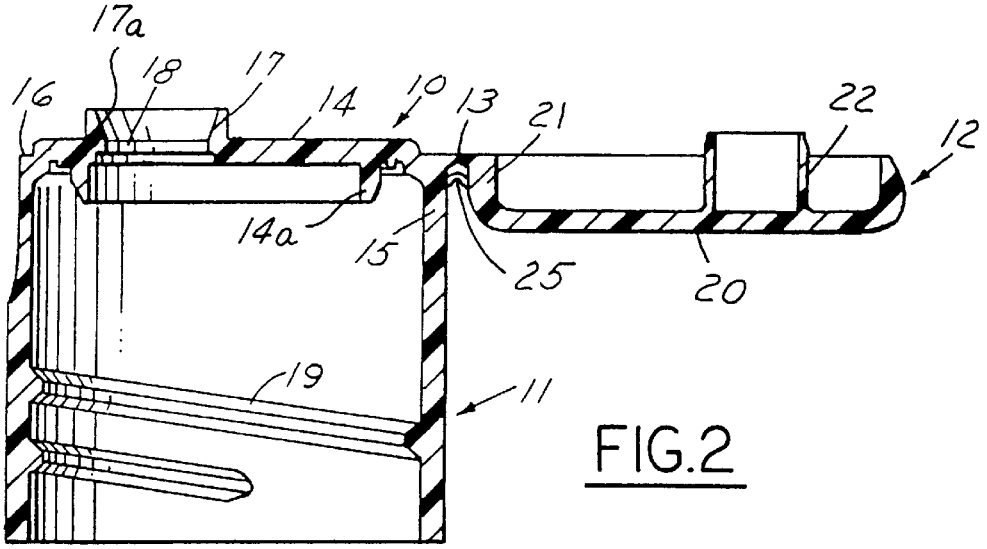
FIG. 2 is a sectional view taken along the line 2—2 in FIG. 1.

Referring to FIGS. 1–7, the closure 10 embodying the invention is made of plastic such as polypropylene and comprises a first part 11 which is adapted to be threaded on the neck of a container, a second part 12 which forms a cap and an integral hinge 13 connecting the first part 11 and second part 12.

The first part includes a base wall 14 and a peripheral skirt 15 with a shoulder 16 at the juncture of the base wall 14 and a peripheral skirt 15. A tubular spout 17 extends from the exterior surface of base wall 14 and terminates in a chamfered rim 17*a*. An annular bead 18 is formed on the inner surface of the spout 17. The skirt 15 is formed with an internal thread 19 on the inner surface thereof for engagement with the threads on the neck of a container. The spout 17 provides a dispensing outlet for the contents of a container on which the closure is applied. An annular integral plug seal 14*a* extends inwardly from the base wall 14 for engaging with an internal surface on the neck of a container.

The second or cap part 12 is formed with a base wall 20 and a peripheral skirt 21. Shoulder 16 is adapted to be engaged by the free edge of the skirt 21. A cylindrical wall or plug 22 is provided on the inner surface of the base wall 20 and is adapted to telescope into the spout 17 when the cap is moved to closed position. Rib 18 provides a friction fit for plug 22 to both insure a tight seal for the contents of the container and clean the spout of contents. The friction fit also secures the second part in closed position.

Integral hinge 13 has a length several times its width to provide stability. The hinge 13 has its upper surface in the plane of the shoulder 16 and the free edge of the skirt 21. The under side of the hinge 13 is in the form of an inverted V in radial cross section. Hinge straps 25 are provided, one on each side of hinge 13. The length of the integral hinge 13 is several times the width of each of the straps 25.

Each strap 25 extends between a recess 26 on part 11 and a recess 27 on part 12. The end of each strap 25 is connected to the recesses 26, 27 horizontally as viewed in FIG. 4.

The configuration of each strap 25 is such that the straps stretch in operation; i.e., in opening and closing part 12 on part 11.

Figure 3:
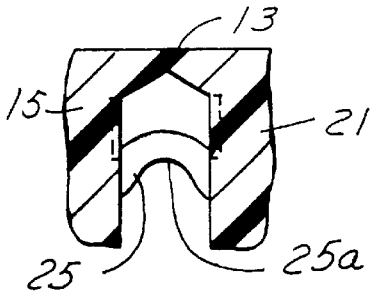
FIG. 3 is a sectional view on an enlarged scale taken along the line 3—3 in FIG. 1.
Figure 4:
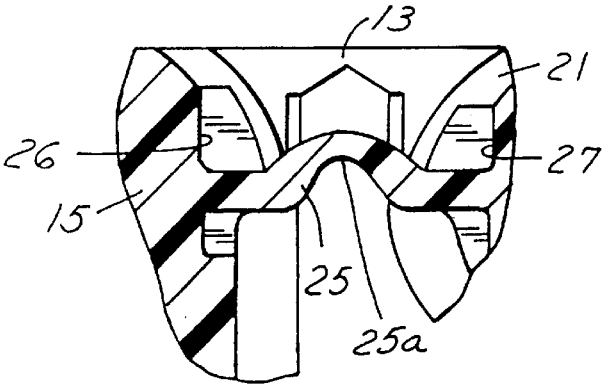
FIG. 4 is a sectional view on an enlarged scale taken along the line 4—4 in FIG. 1.
Figure 5:
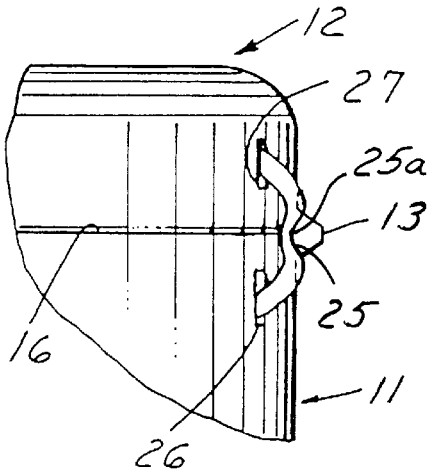
FIG. 5 is a fragmentary elevational view showing the closure in a closed position.
Figure 6:
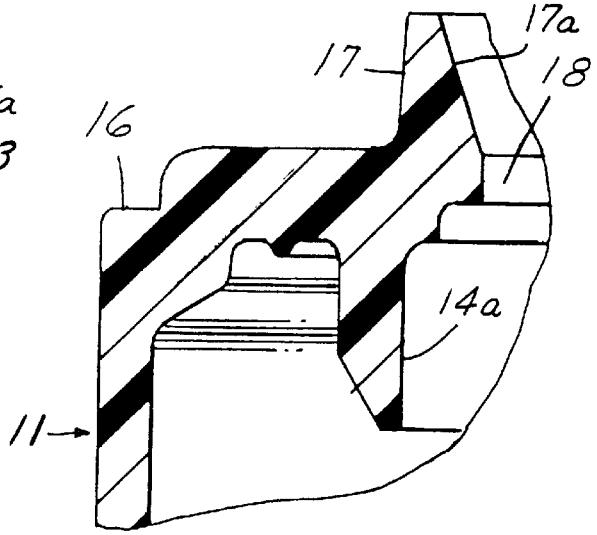
FIG. 6 is a fragmentary sectional view of a portion of the closure.
Figure 7:
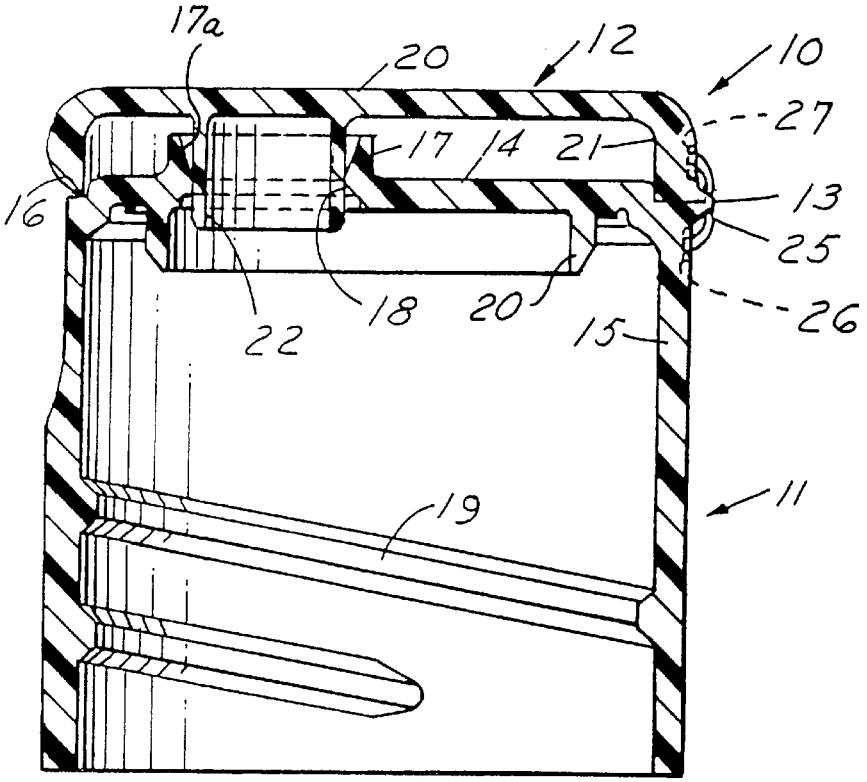
FIG. 7 is a sectional elevational view of the closed closure.

Each strap 25 has its ends straight and lying in the same plane when the first part 11 and second part 12 are in fully open position. In this position, an intermediate portion 25*a* of each strap 25 which extends axially out of the plane, herein shown as upwardly curved (FIGS. 3 and 4).

Figure 8:
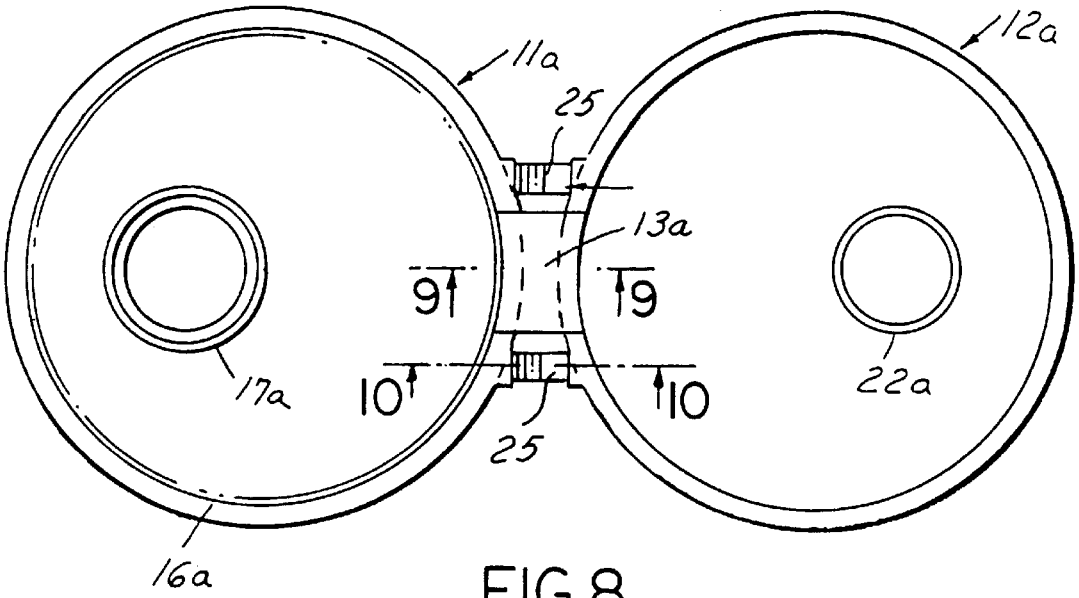
FIG. 8 is a plan view of a modified form of closure in an open position.
Figure 9:
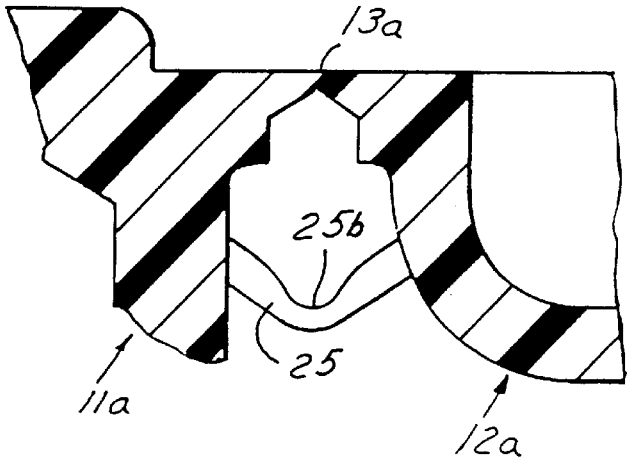
FIG. 9 is a sectional view on an enlarged scale taken along the line 9—9 in FIG. 8.
Figure 10:
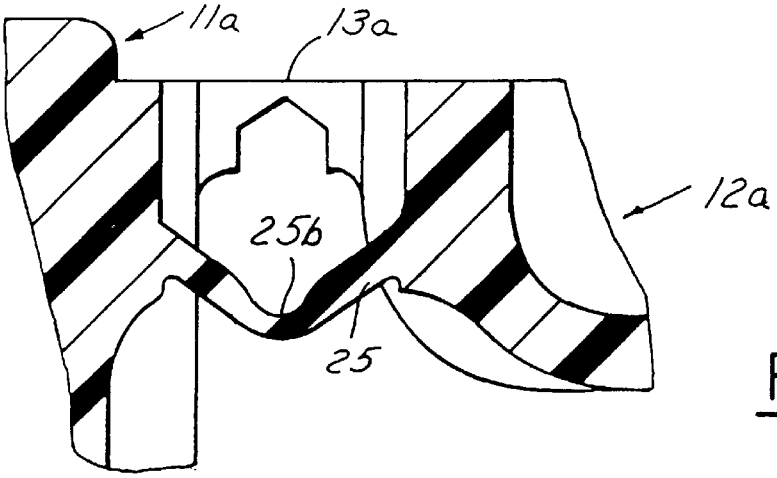
FIG. 10 is a sectional view on an enlarged scale taken along the line 10—10 in FIG. 8.

In the modified form shown in FIGS. 8–10, corresponding parts are designated with a letter suffix. This form differs in that the intermediate portion 25*b* of each strap is V-shaped in cross section and extends downwardly.

In accordance with the invention, the center portion 25*a* or 25*b* of each strap is made thinner than the ends for about 50% of its length. The width of each strap is the same throughout. As a result, each strap stretches more in the thinner intermediate portion.

Figure 11:
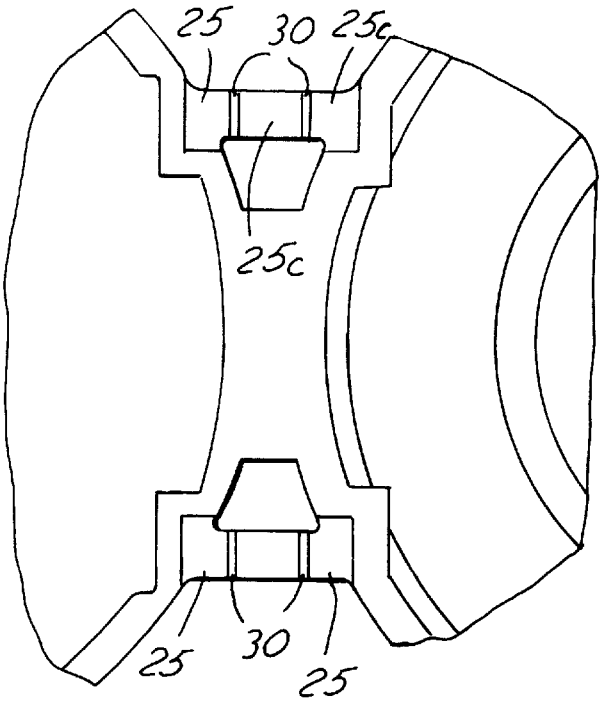
FIG. 11 is a fragmentary plan view of a further modified form of closure in the open position.
Figure 12:
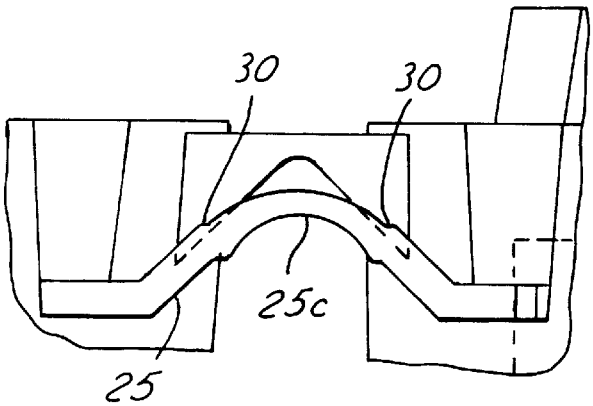
FIG. 12 is a fragmentary elevational view of the closure shown in FIG. 11.

In the form of the invention shown in FIGS. 11 and 12, corresponding parts have the suffix "c". In this form, the thinner intermediate portion 25*c* is connected to the remaining portions or ends of each strap 25 by a step or ledge 30. As a result, the thickness of the intermediate portion 25*c* can be controlled along its entire length, that is, is uniformly along its length.

Figure 13:
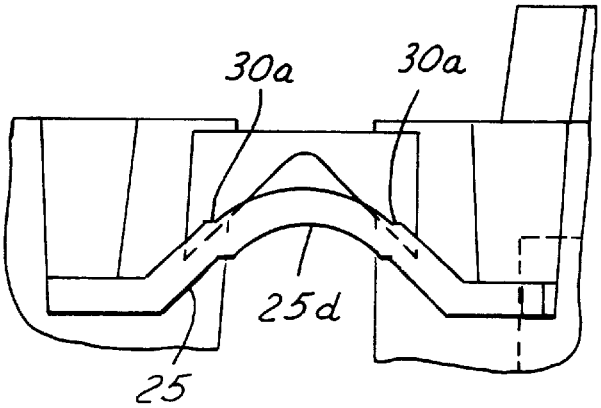
FIG. 13 is a view similar to FIG. 12 of another form of the invention.

In the modified form shown in FIG. 13, the straps have the outer portion 25*d* of the same thickness as the ends and include ledges or shoulders 30*a*.

It can thus be seen that there has been provided a closure of the snap-hinge type improved performance and longer life; which further reduces or eliminates excessive stress on the straps during opening and closing which might cause breaking; and which can be made with minimal added cost.

I claim:

1. A closure with a snap type hinge cap comprising a first part adapted to interengage with an open neck of a container, a second part forming a cap, an integral hinge interconnecting the first part and second part, each of said parts comprising a base wall and a peripheral skirt, a pair of hinged straps attached to said skirts and extending from the skirts on opposite side of said integral hinge, each said strap having spaced ends hinged to said skirts, the ends of said straps being straight and lying in substantially the same plane when the first part and second part are in fully open positions, each said strap being stretched along its length during opening and closing of said first part and second part, each said strap having a portion intermediate said ends which extends out of said plane when the first part and second part are in fully open position, each intermediate portion of each strap having a central portion which is thinner than the ends of said strap, and each said strap being untensioned when the first part and second part are in fully open position.

2. The closure set forth in claim 1 wherein the end of each said intermediate portion of each said strap is connected to a strap end by a transverse ledge.

3. The closure set forth in claim 1 wherein the end of each said strap is connected horizontally to said skirt of said first part and said skirt of said second part.

4. The closure set forth in claim 3 wherein said skirt of each first part and said skirt of said second part have recesses, said straps having their ends hinged to said skirts in said recesses.

5. The closure set forth in claim 1 wherein said intermediate portions of said straps extend axially in one of an axially downwardly or an axially upwardly direction out of said plane when the first part and second part are in fully open position.

6. The closure set forth in claim 5 wherein said intermediate portions of said straps are curved in cross section along the length of said intermediate portions.

7. The closure set forth in claim 5 wherein said intermediate portions of said straps are V-shaped in cross section along the length of said intermediate portions.

8. The closure set forth in any one of claims 1–2 wherein said intermediate portion of each strap is thinnest at the center of said intermediate portion and tapers to end portions of said strap.

9. A closure with a snap type hinge cap comprising a first part adapted to interengage with an open neck of a container, a second part forming a cap, an integral hinge interconnecting the first part and second part, each of said parts comprising a base wall and a peripheral skirt, a pair of hinged straps attached to said skirts and extending from the skirts on opposite side of said integral hinge, each said strap having spaced ends hinged to said skirts, the ends of said straps being straight and lying in substantially the same plane when the first part and second part are in fully open positions, each said strap being stretched along its length during opening and closing of said first part and second part, each said strap having a portion intermediate said ends which extends out of said plane when the first part and second part are in fully open position, each end of each said intermediate portion of each said strap being connected to each end of said strap by a transverse ledge, each said strap being untensioned when the first part and second part are in fully open position.

10. The closure set forth in claim 9 wherein the end of each said strap is connected horizontally to said skirt of said first part and said skirt of said second part.

11. The closure set forth in claim 10 wherein said skirt of each first part and said skirt of said second part have recesses, said straps having their ends hinged to said skirts in said recesses.

12. The closure set forth in claim 9 wherein said intermediate portions of said straps extend axially in one of an axially downwardly or an axially upwardly direction out of said plane when the first part and second part are in fully open position.

13. The closure set forth in claim 12 wherein said intermediate portions of said straps are curved in cross section along the length of said intermediate portions.

14. The closure set forth in claim 12 wherein said intermediate portions of said straps are V-shaped in cross section along the length of said intermediate portions.

15. The closure set forth in any one of claims 9–14 wherein said intermediate portion of each strap is thinner than said ends, being thinnest at the center of said intermediate portion and tapering to said ends of said strap.

16. The closure set forth in any one of claims 9–14 wherein said intermediate portion of each said strap has the same thickness throughout.

* * * * *